US007679572B2

(12) United States Patent
Gray et al.

(10) Patent No.: US 7,679,572 B2
(45) Date of Patent: Mar. 16, 2010

(54) BODY MOUNT FOR A VEHICLE ANTENNA

(75) Inventors: Matthew Gordon Gray, Brighton, MI (US); Michael David Lungu, Fraser, MI (US)

(73) Assignee: Harada Industry of America, Inc., Novi, MI (US)

( * ) Notice: Subject to any disclaimer, the term of this patent is extended or adjusted under 35 U.S.C. 154(b) by 57 days.

(21) Appl. No.: 11/904,238

(22) Filed: Sep. 26, 2007

(65) Prior Publication Data

US 2009/0079640 A1 Mar. 26, 2009

(51) Int. Cl.
*H01Q 1/32* (2006.01)
*H01Q 1/12* (2006.01)

(52) U.S. Cl. ..... 343/713; 343/878

(58) Field of Classification Search ..... 343/713, 343/715, 878, 906
See application file for complete search history.

(56) References Cited

U.S. PATENT DOCUMENTS 4,945,361 A 7/1990 Egashira
5,583,522 A 12/1996 Radomski et al.
5,995,053 A 11/1999 Curtis
6,271,797 B2 8/2001 Miller
6,509,878 B1 1/2003 Tornatta, Jr. et al.
6,714,171 B2 * 3/2004 Haussler et al. ..... 343/888
6,747,603 B1 6/2004 Tornatta, Jr. et al.
6,879,301 B2 * 4/2005 Kozlovski ..... 343/878

* cited by examiner

*Primary Examiner*—Shih-Chao Chen
(74) *Attorney, Agent, or Firm*—William L. Androlia; H. Henry Koda

(57) ABSTRACT

A mounting for a vehicle antenna including a mounting base which has an insertion portion for insertion through a hold in a vehicle body panel and a flange for engagement with an inner surface of the vehicle panel. The mounting further includes a temporary retainer at least two resilient temporary retention arms extending upward from engaging with the outer surface of the vehicle body panel after being inserted through the hole in the vehicle body panel. A retainer is then provided in the insertion portion to permanently mount the mounting to the vehicle body panel.

10 Claims, 4 Drawing Sheets

BODY MOUNT FOR A VEHICLE ANTENNA

BACKGROUND OF THE INVENTION

1. Field of the Invention

The present invention relates to antenna mountings for vehicles and particularly to mountings for vehicle antenna on a vehicular body panel such as a fender.

2. Prior Art

In the prior art, there exists several means for mounting an antenna to motor vehicle bodies. Such antenna mountings generally fall into two categories. One category is wherein the antenna mount is inserted from the outside of the vehicle body and mounted to the vehicle body by screws from the outside. The second category is wherein the antenna mounting is inserted through a hole in the vehicle body panel from the inside and a retainer is places on the outside to hold the antenna in place permanently.

Each of these two means of mounting an antenna has its disadvantages. The first one is disadvantageous in that the utilization of screws provides a mounting which is not aesthetic and if it is required to make it aesthetic, a separate piece must be places over the screws which can come off during the assembly process of the total vehicle or will ultimately be lost by the owner of the vehicle during the life span of the vehicle. The second mounting is disadvantageous in that it requires tow workers in order to install it. One is on the outside of the vehicle body and the other is on the inside. In particular, the worker on the inside inserts the mounting through the hole and the worker on the outside then holds the antenna while installing the retainer on the outside of the body panel.

Examples of each of the above tow types of antenna mountings are contained in one or more of U.S. Pat. Nos.:

| | |
|---|---|
| 4,945,361 | 5,583,522 |
| 5,995,053 | 6,271,797 |
| 6,509,878 | 6,747,603 |

SUMMARY OF THE INVENTION

It is a general object of the present invention to overcome the disadvantages of the prior art. In particular, it is an object of the present invention to provide an antenna mounting which is inexpensive and can be easily installed by single worker.

It is still another object of the present invention to provide an antenna which provides an aesthetic appearance.

In keeping with the principles and objects of the present invention, the present invention is a mounting for a vehicle antenna which includes a mounting base, at least two temporary resilient retention arms, a hosel and a retainer. The mounting base includes an insertion portion for insertion through a hole in a vehicle body panel, a flange portion provided on the insertion portion for engagement with an inner surface of the vehicle body panel. The at least two temporary resilient retention arms are provided on the flange portion adjacent the insertion portions. The two temporary retention arms are for engaging with the outer surface of the vehicle body panel after being inserted through the hole in the panel. The retainer is provided over the insertion portion and engages with the outer surface of the vehicle body panel and provides an aesthetic appearance. The retainer means fit on to the insertion portion of the mounting base and permanently mounts the antenna mounting to the vehicle body panel.

With the above structure, during the installation of the antenna, the mounting is inserted through the hole in the vehicle body panel until the flange portion engages with an inner surface of the vehicle body panel and the at least tow temporary retention arms are compressed and then expand to engage with the top surface of the vehicle body panel to temporarily retain the mounting in the hole until the hosel and the retaining means are installed on the insertion portion of the mounting base to permanently install the mounting on the vehicle body.

BRIEF DESCRIPTION OF THE DRAWINGS

The above-mentioned features and objects of the present invention will become more apparent with reference to the following description taken together with the accompanying drawings wherein like reference numerals denote like elements an din which.

DETAILED DESCRIPTION OF THE INVENTION

Figure 1:
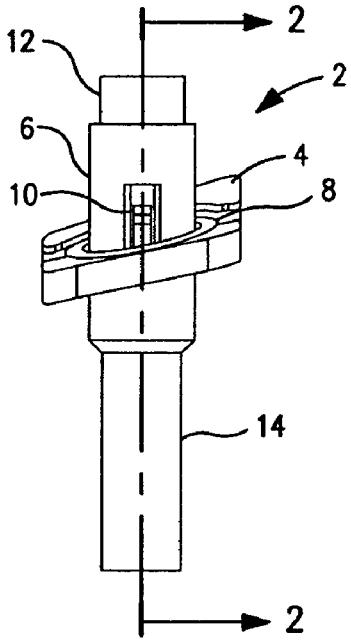
FIG. 1 is an end view of the vehicle antenna mounting in accordance with the present invention.
Figure 2:
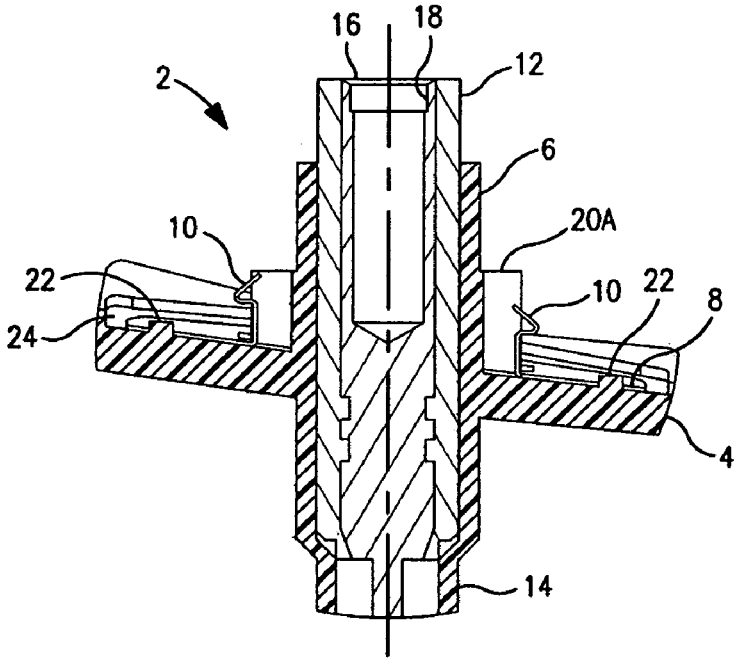
FIG. 2 is a cross-section along line 2-2 of FIG. 1.

Referring to FIGS. 1-5, shown therein is the antenna mounting 2 an the method of installation. In particular, the mounting 2 comprises a mounting base which includes a flange 4 which is integrally formed with an insertion portion 6 and an antenna connecting cable portion 14. While these parts are shown and described as being integrally made, it is also possible to make these as separate pieces. Within the insertion portion 6 is further provided a retainer mount 12 and an antenna coupling 16 with an antenna insertion hole 18. The mounting base comprising the flange 4, insertion portion 6 and antenna cable coupling 14 is molded from an insulating material such as plastic resin.

A temporary retainer 8 in the form of a plate with two upwardly extending resilient temporary retention arms is provided in a recess 24 formed in a top surface of the flange 4 and holes in the temporary retainer 8 fit onto mounting projections 22 which extend upwardly from the flange 4 inside the recess 24.

The two resilient temporary retention arms which upwardly extend from the retainer 8 have a top portion which is bent in a half triangular shape. The distance from the top surface of the retainer 8 to the half base of the triangular portion is substantially equal to the thickness of the body panel and the sloping surface of the half triangle is for ease of installation. In particular, the sloping surface contacts the hole in the body panel from the inside and the sloping surface allows the retaining arms 10 to be easily compressed while being inserted through the hole 32 in the body panel 30.

The mounting base can further be provided with wall portions 20A and 20B provided on each side of the retaining arms 10. These walls 20A and 20B can provide a recess into which the retaining arms can be compressed while being inserted through the hole 32 in the body panel 30. In addition, if the hole 32 is provided with the cutouts 40 at both ends which accommodate the walls 20A and 20B, the walls 20A and 20B further act to prevent the mounting flange 4 from rotating after being inserted through the hole 32 and further facilitating the ease of installation.

The antenna mounting is generally made from a conductive material to be able to make electrical connection to the antenna 36 and the retainer 8 and the temporary resilient retention arms 10 are typically made out of metal but could be made from other materials such as plastic resins and the like. The only requirement on the material for the retainer 8 and resilient temporary retention arms 10 is that they be flexible and have sufficient strength to be able to retain the antenna mounting in the hole 32.

Figure 3:
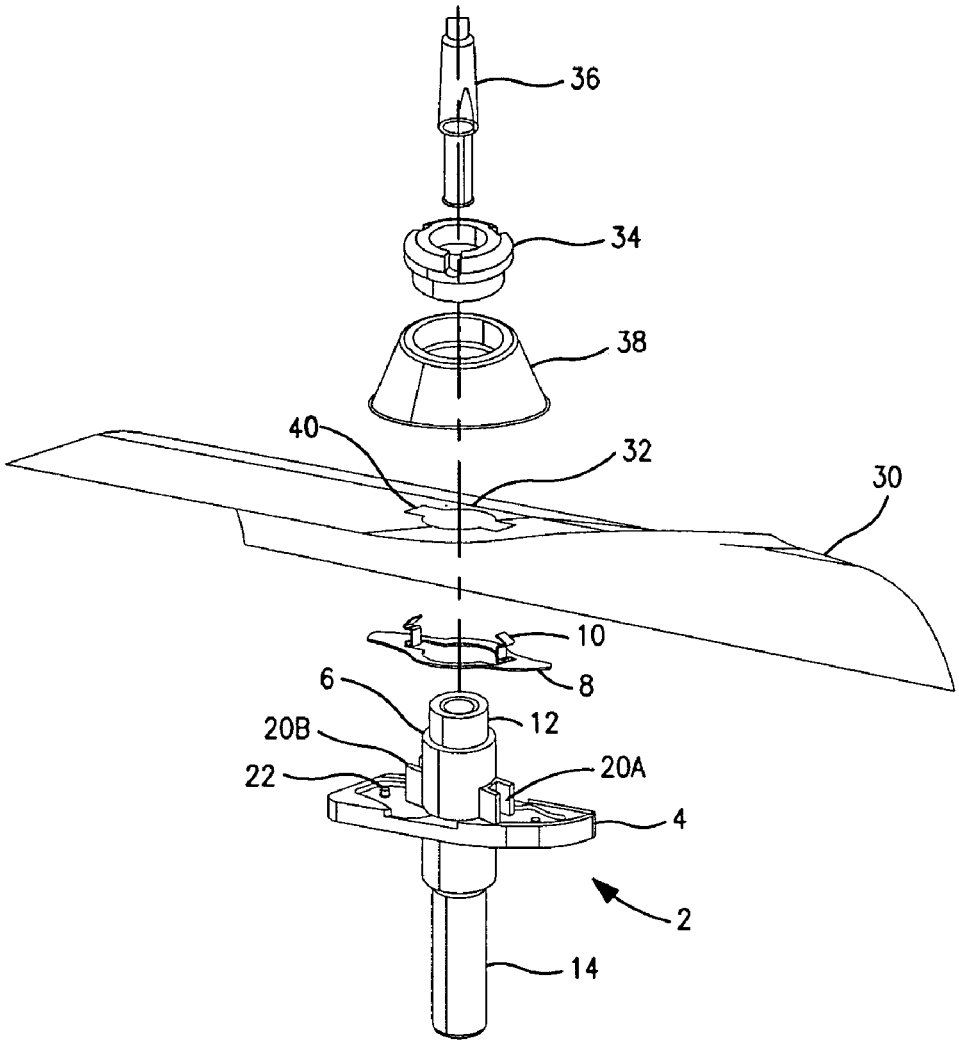
FIG. 3 is an exploded view of the present invention as it is mounted on a vehicle body panel.
Figure 4:
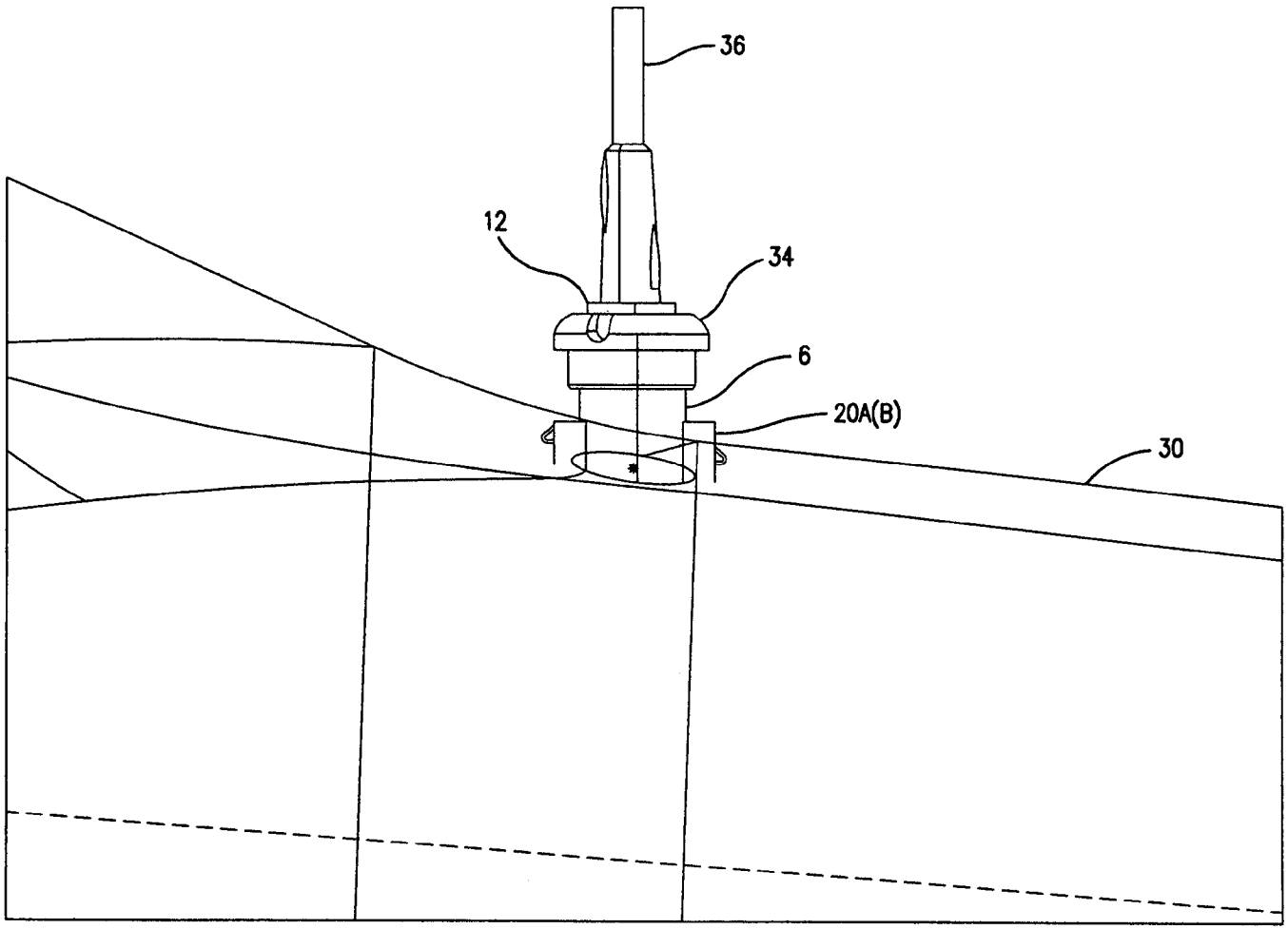
FIG. 4 illustrates the insertion portion being inserted through a hole in the vehicle body panel.
Figure 5:
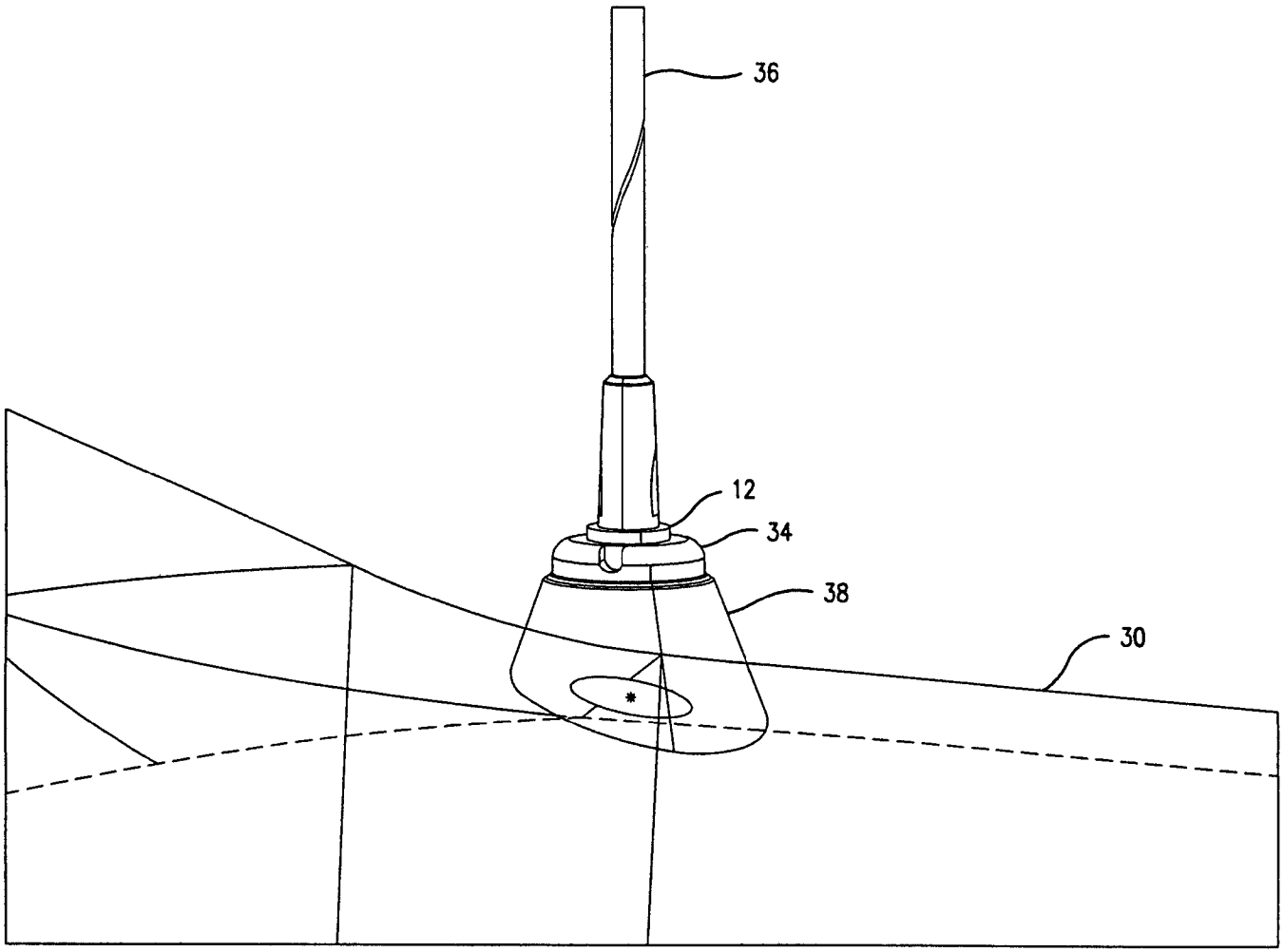
FIG. 5 shows an exterior view of the antenna mounting and antenna installed permanently on the vehicle body panel.

Referring more particularly to FIGS. 3-5, shown therein is the method of utilization of the antenna mounting 2 of the present invention. In particular, the insertion portion 6 together with the flange 4 with the retainer 8 and upwardly extending temporary retention arms are inserted into the hole 32 in the body panel 30. While being inserted, the temporary retention arms 10 are compressed into the recess formed between the walls 20A and 20B. Once the temporary retention arms extend so that the half base of the triangular extends beyond the thickness of the body panel 30, the temporary retention arms 10 expand outwardly and engage with the hole 32 and the top surface of the body panel 30 to temporarily hold the mounting in the hole 32. This can all be done by a single individual or worker.

The worker then places the hosel 38 over the insertion portion 6 and applies the retainer 34. The retainer 34 may be screwed onto the retainer mounting portion 12 or attached thereto by some other means as an adhesive, quick drying cement or thermal plastic. The antenna cable (not shown) is then connected to the antenna cable mounting portion 14.

With the above described present invention, the antenna can be easily mounted to a body panel of a vehicle by a single worker and provide an inexpensive and aesthetic mounting.

It should be apparent to those skilled in the art that the above-described embodiments of the present invention comprises only one of a plurality of embodiments which could be created without departing from the spirit and the scope of the invention.

The invention claimed is:

1. A mounting for a vehicle antenna, said mounting comprising:

a mounting base, said mounting base comprising an insertion portion for insertion through a hole in a vehicle body panel, a flange portion provided on said insertion portion for engagement with an inner surface of said vehicle body panel;

at least two temporary resilient retention arms provided on said flange portion adjacent said insertion portion, said two temporary retention arms for engaging with an outer surface of said vehicle body panel after being inserted through said hole in said body panel;

a mounting hosel provided on said insertion portion and for engaging with said outer surface of said vehicle body panel; and retainer means for holding said insertion portion of said mounting base;

whereby during installation of an antenna the mounting is inserted through said hole in said vehicle body panel until said flange portion engages with an inner surface of said vehicle body panel and said at least two temporary retention arms are compressed and then engage with said outer surface of said vehicle body panel to temporarily retain said mounting in said hole until said retainer means and hosel is installed on said insertion portion of said mounting base to permanently install said mounting.

2. The mounting for a vehicle antenna according to claim 1, wherein said at least two temporary retention arms extend upwardly from and are integrally formed with a metal retention plate.

3. The mounting for a vehicle antenna according to claim 2, wherein said flange is provided with a recessed surface into which said metal retention plate is fitted.

4. The mounting for a vehicle antenna according to claim 1, wherein the insertion portion is provided with an antenna retention hole.

5. The mounting for a vehicle antenna according to claim 1, wherein said insertion portion is provided with outwardly projecting walls on each side of said at least two temporary resilient retention arms for providing recesses into which said at least two temporary resilient retention arms can be compressed when said mounting is inserted through said hole in said vehicle body panel to make the installation of said mounting easier.

6. The mounting for a vehicle antenna according to claim 1, wherein a top surface of each said at least two temporary resilient retention arms is a sloped surface for ease of insertion in said hole in said vehicle body panel.

7. The mounting for a vehicle antenna according to claim 1, wherein each of said at least two temporary resilient retention arms is provided with an outwardly projecting retention portion.

8. The mounting for a vehicle antenna according to claim 7, wherein a distance from a top surface of said flange portion to said outwardly projecting retention portions is substantially equal to a thickness of said vehicle body panel.

9. The mounting for a vehicle antenna according to claim 1, wherein the at least two temporary resilient retention arms are integrally formed with said flange of said mounting base.

10. The mounting for a vehicle antenna according to claim 9, wherein said mounting base is made from plastic resin.

* * * * *